United States Patent [19]

Chen

[11] Patent Number: 4,816,625

[45] Date of Patent: Mar. 28, 1989

[54] COMBINATIVE MULTI-CONTACT SYNCHRONOUS SLIDE SWITCH

[76] Inventor: Sun C. Chen, Fl. 11, No. 101, Sung Chiang Road, Taipei, Taiwan

[21] Appl. No.: 75,893

[22] Filed: Jul. 21, 1987

[51] Int. Cl.[4] ..... H01H 15/02; H01H 9/02

[52] U.S. Cl. ..... 200/16 D; 200/307

[58] Field of Search ..... 200/16 C, 16 D, 17 R, 200/18, 307, 153 P

[56] References Cited

U.S. PATENT DOCUMENTS

| | | | |
|---|---|---|---|
| 3,072,757 | 1/1963 | Gluck | 200/16 D |
| 3,196,223 | 7/1965 | Hartsock | 200/18 X |
| 3,525,828 | 8/1970 | Eckhart et al. | 200/16 D |
| 3,735,059 | 5/1973 | Glaser et al. | 200/307 X |
| 4,224,484 | 9/1980 | Haas et al. | 200/307 X |

*Primary Examiner*—J. R. Scott

*Attorney, Agent, or Firm*—Morton J. Rosenberg

[57] ABSTRACT

This invention relates to a combinative multi-contact synchronous slide switch and in particular to one which may be accurately operated and easily assembled. The switch mainly includes a PC board, a sliding plate, a turning axis and two clipping rods. The sliding plate is pressed firmly against the PC board by the clipping rods. The sliding plate slides by way of a cog and a turning axle. The sliding plate can slide on the PC board assembly by way of a spring, a steel ball and several slipping holes on the PC board. A number of contact plates are clipped in concave channels formed at the back of the sliding plate. When the sliding plates slide, they are able to contact the corresponding points on the PC board to operate the switch. Further, the sliding plate is formed with convex and concave edges thereby enabling it to be easily interconnected with other sliding plates.

2 Claims, 5 Drawing Sheets

COMBINATIVE MULTI-CONTACT SYNCHRONOUS SLIDE SWITCH

BACKGROUND OF THE INVENTION

This invention relates to a combinative multi-synchronous slide switch.

Heretofore, many prior multi-contact switch as shown in FIG. 1 include plate A having some springs, plate B having some contact points and a rotary device. The plate B is held by two axles D. The plate A which has springs on it is fixed to the turning axle E of rotary device C. When the turning axis E rotates, it drives plate A and functions as a rotary selective switch. But this kind of switch has the following disadvantages:

(1) As shown in FIG. 1, it is inconvenient to connect the terminals of the plate B to the terminals of other devices.

(2) When it is desired to increase the number of the contacts of the switch, the number of layers on the turning axle E have to be increased. This causes poor contact of the rear layers due to the fact that the torque of the turning axle E cannot be evenly transmitted to the rear layers.

(3) Plates A and B are all mounted on the turning axle E, but the turning and fixing of axle E are controlled by only one steel ball F and one fixing plate G (see FIG. 1). This makes the switch hard to be turned.

SUMMARY OF THE INVENTION

It is the primary object of the present invention to provide a combinative multi-contact synchronous slide switch which gives precise contact and prevents poor contact of the prior art switch.

It is another object of the present invention to provide a combinative multi-contact synchronous slide switch which can be operated smoothly by its synchronous slide method.

It is still another object of the present invention to provide simple connection of the terminals of the switch at one time.

It is still a further object of the present invention to provide a combinative switch by the combination of the sliding plates.

DETAILED DESCRIPTION OF THE PREFERRED EMBODIMENT

Figure 1:
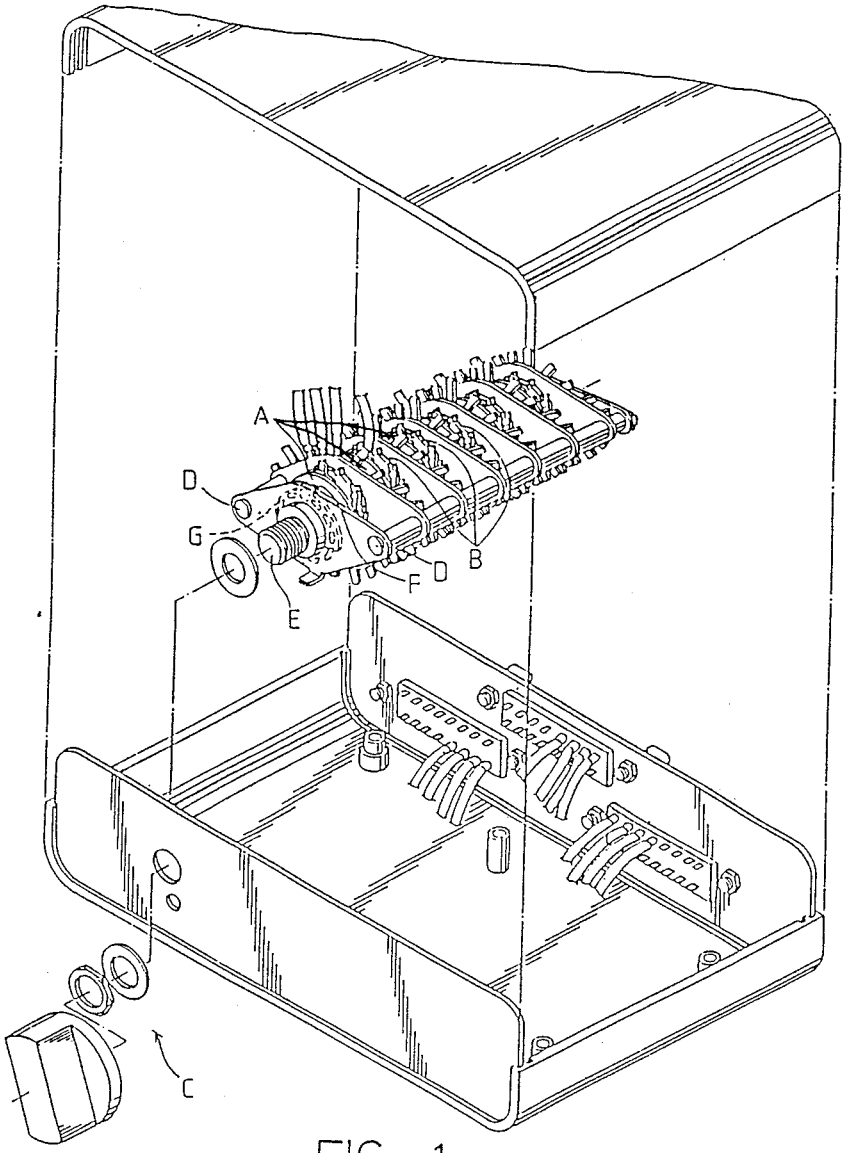
FIG. 1 PRIOR ART
FIG. 1 is an exploded view of a prior art multi-contact rotary switch.
Figure 2:
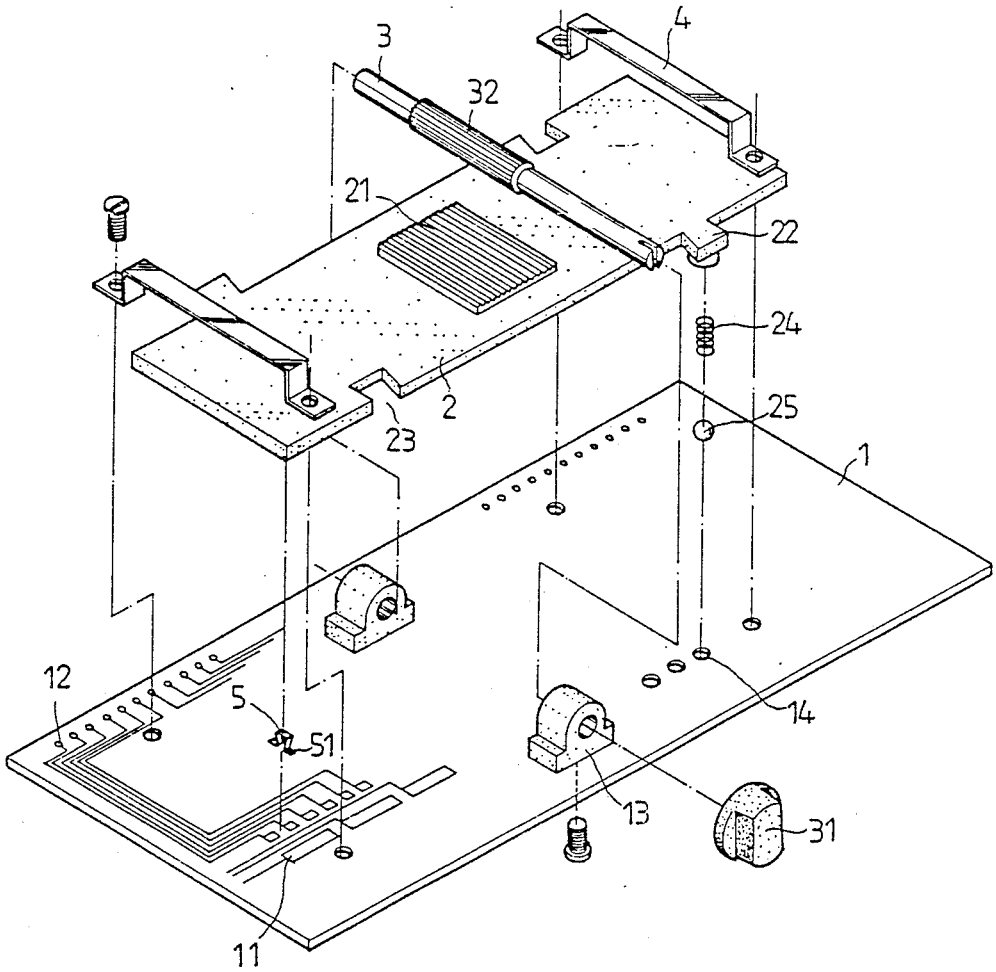
FIG. 2 is a perspective and exploded view of the present invention.

With reference to FIG. 2, the present invention mainly comprises a PC board 1, a sliding plate 2, a turning axle 3 and two clipping rods 4. On the PC board 1, there are circuits 11 consisting of fixed contacts in predetermined arrays, sockets 12, fixing holes 14 and two bearings 13 at the two opposing sides of the central part for the mounting of the turning axle 3.

Figure 3:
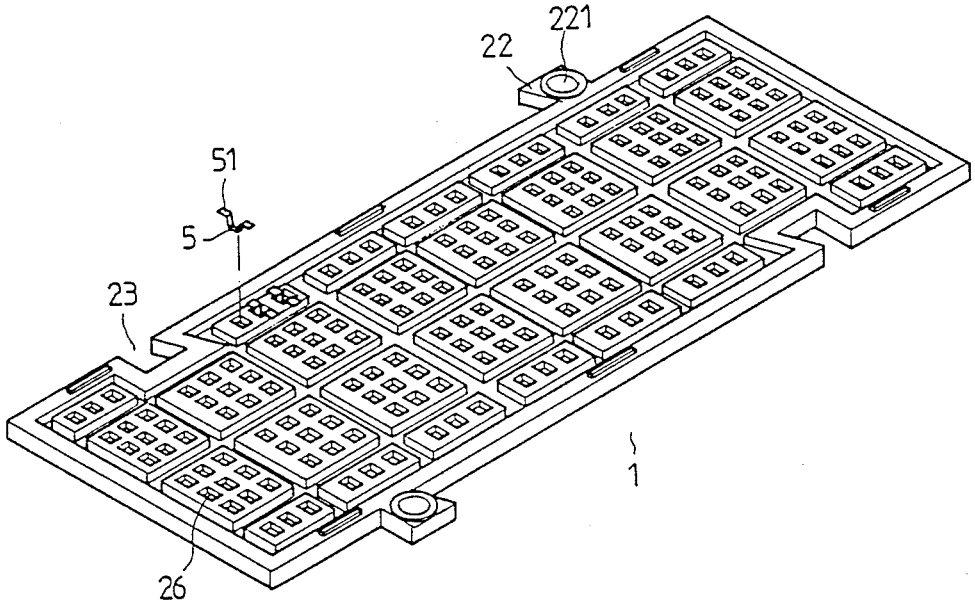
FIG. 3 shows the combination of the contact plates and the sliding plate of the present invention.

The sliding plate 2 is pressed firmly against the PC board 1. There is a cog plate 21 on the sliding plate 2. A convex edge 22 and a concave edge 23 are formed on opposing sides of the sliding plate 2. A hollow insert portion 221 is located at the back of the convex edge 22 and a spring 24 pressing a steel ball 25 are both disposed inside the hollow insert portion 221. By the spring force and the steel ball pressing on the fixing holes 14, the sliding plate is allowed to move in several positions smoothly. As shown in FIG. 3, a plurality of concave channels 26 are formed within the back of sliding plate 2.

Contact plates 5 having an inverted-U shape are clipped in the concave channels 26 with terminals 51 thrusting out from the concave channels 26 maintaining contact with the PC board 1. The contact plate terminals 51 obviously engage pairs of fixed contacts of circuits 11 in different positions of the sliding plate 2.

The turning axle 3 is enveloped by bearings 13 on the PC board 1 with one of their ends thrusting out and fixed with a knob 31 for turning. The cog 32 in the middle of turning axle 3 is formed to matingly interface with cog plate 21 on the sliding plate 2 so that the sliding plate can be driven.

The clipping rods are U-shaped in formation. These rods are inversely mounted on the PC board 1 and extend above the sliding plate 2. The edges of these clipping rods can limit the motion of the convex edge 22 of the sliding plate 2 and ensure a suitable stable, linear displacement of the sliding plate.

Figure 4:
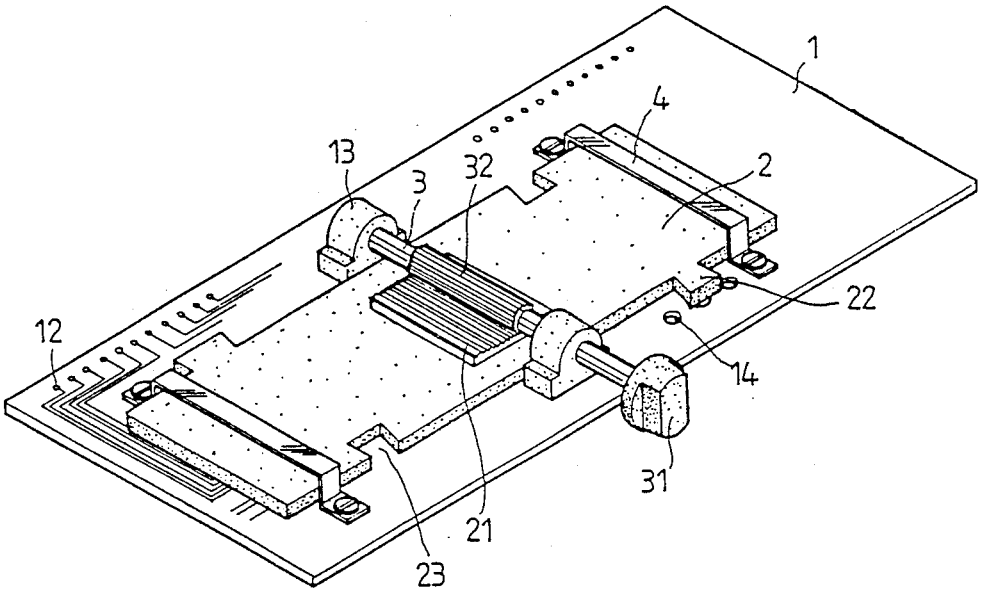
FIG. 4 shows the mechanism of the present invention.

FIG. 4 shows the compositions of the present invention. The clipping rods 4 are mounted to prevent the sliding plate from improper displacement. The sliding plate 2, by means of the spring 24, steel ball 25 and the fixing holes 14 on the PC board, makes a suitable contact force to ensure the terminals 51 of the contact plates 5 to firmly engage the fixed contacts of circuits 11 located on the PC board 1. Therefore, when the turning knob 31 is rotated, all the sliding plate components are driven to move and form a combinative multi-contact synchronous slide switch.

Figure 5:
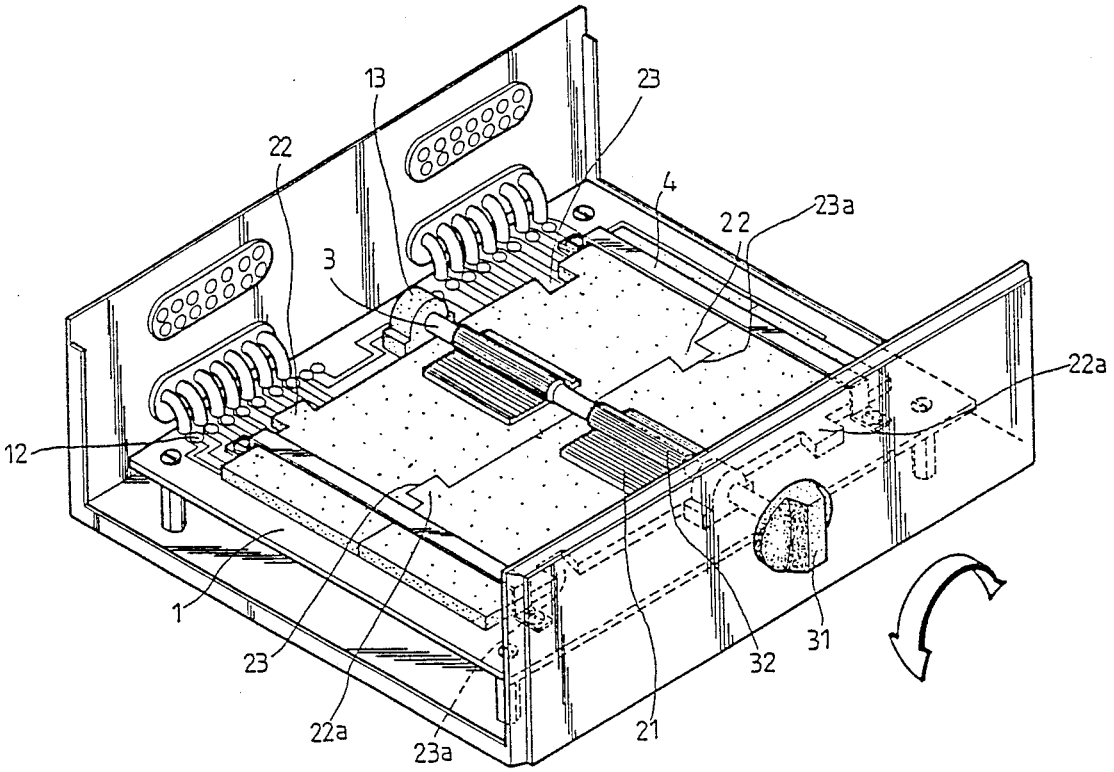
FIG. 5 shows the expanding combination of the present invention.

FIG. 5 shows an expanded version combination of the present invention. When the convex edges 22 and 22*a* of the present invention are clipped to the concave edges 23*a* and 23 of the sliding plate 2 of the adjacent as well as the same switches, and also when the concave channels 23 and 23*a* are clipped to the convex edges 22*a* and 22 of the sliding plate 2, an expanded combination may be obtained. Accordingly, the turning axle 3 and the clipping rods 4 may also be adjusted by incorporation of a turning rod 3 which includes cogs 32 for matingly engaging cog plates 21 and clipping rods 4 which are mounted on opposing sides of sliding plates 21.

The connection of terminals of the present invention is so simple that it becomes a characteristic of the present invention. The simplicity is derived from the fact that all necessary circuits 11 are already made on the PC board 1, controlled by the sliding plate 2 and the contact plates 5; therefore, the present invention can be expanded very easily to suit different circuits.

Although this invention has been described with a certain degree of particularity, it is understood that the present disclosure has been described with a certain degree of particularity and the combination and arrangement of parts may be resorted to without departing from the spirit and scope of the invention as hereinafter claimed.

I claim:

1. A combinative multi-contact synchronous slide switch comprising:

a PC board having a plurality of circuits including a plurality of fixed contacts and, sockets and two bearings mounted on opposing sides of a central portion of said PC board;

a sliding plate with a cog thereon, said sliding plate having a concave hollow insert portion formed within a back surface for receiving a spring and a steel ball, said steel ball engaging fixing holes formed in said PC board to thereby maintain said slider plate in fixed positions with respect to the PC board, a plurality of U-shaped contact plates having terminals, said contact plates being retained in concave channels located in said back surface of said sliding plate, said contact plate terminals extending out of said channels, and engaging selected fixed contacts of said plurality of circuits on said PC board;

a turning axle rotatably mounted in said bearings, said turning axle having threads engaged with said cog of said sliding plate to move said sliding plate translationally; and, two U-shaped clipping rods mounted firmly on said PC board at respective positions extending above said sliding plate, the ends of said clipping rods being formed to engage and guide said sliding plate in its linear movement with respect to said PC board.

2. A combinative multi-contact synchronous slide switch as claimed in claim 1, further comprising a pair of concave channels and convex edges at each side of said sliding plate to form an expanding combinative switch when said concave channels are clipped to the convex edges of an adjacent sliding plate.

* * * * *